US006885833B2

(12) United States Patent
Stelter et al.

(10) Patent No.: US 6,885,833 B2
(45) Date of Patent: Apr. 26, 2005

(54) REDUCTION OF BANDING AND MOTTLE IN ELECTROPHOTOGRAPHIC SYSTEMS

(75) Inventors: Eric C. Stelter, Pittsford, NY (US); Kenneth P. Friedrich, Honeoye, NY (US); Joseph Guth, Holley, NY (US)

(73) Assignee: Eastman Kodak Company, Rochester, NY (US)

( * ) Notice: Subject to any disclaimer, the term of this patent is extended or adjusted under 35 U.S.C. 154(b) by 43 days.

(21) Appl. No.: 10/176,956

(22) Filed: Jun. 21, 2002

(65) Prior Publication Data

US 2003/0016960 A1 Jan. 23, 2003

Related U.S. Application Data

(60) Provisional application No. 60/302,457, filed on Jul. 2, 2001.

(51) Int. Cl.[7] ..... G03G 15/00
(52) U.S. Cl. ..... 399/48; 399/49
(58) Field of Search ..... 399/49, 48, 72, 399/74, 73; 382/112

(56) References Cited

U.S. PATENT DOCUMENTS

| | | | | |
|---|---|---|---|---|
| 4,602,863 A | | 7/1986 | Fritz et al. | |
| 5,376,492 A | | 12/1994 | Stelter et al. | |
| 5,652,946 A | * | 7/1997 | Scheuer et al. | 399/49 |
| 5,853,941 A | | 12/1998 | Rimai et al. | |
| 5,937,229 A | | 8/1999 | Walgrove et al. | |
| 5,946,521 A | * | 8/1999 | Budnik et al. | 399/24 |
| 6,121,986 A | | 9/2000 | Regelsberger et al. | |
| 6,275,600 B1 | * | 8/2001 | Banker et al. | 382/112 |
| 6,529,616 B1 | * | 3/2003 | Rasmussen et al. | 382/112 |
| 6,571,000 B1 | * | 5/2003 | Rasmussen et al. | 382/112 |
| 6,606,395 B1 | * | 8/2003 | Rasmussen et al. | 382/112 |

FOREIGN PATENT DOCUMENTS

JP 09204117 A * 8/1997 ..... G03G/21/00

OTHER PUBLICATIONS

Opek Technology, Inc., 1215 W. Crosby Road, Carrollton, Texas 75006 Product Bulletin OP913SL, Jun. 1996, PIN Silicon Photodiodes Types OP913SL, OP913WSL.

* cited by examiner

*Primary Examiner*—Robert Beatty
(74) *Attorney, Agent, or Firm*—Richard A. Romanchik

(57) ABSTRACT

A mechanism and process for detecting mottle or banding in a developed electrophotographic image. Within an electrophotographic reproduction apparatus 10, a photoconductor is used for receiving and developing a latent image. The photoconductor traverses a path that passes a charging station 28, an exposure station 34, a toning station 38, and a transfer station 46. Either a densitometer 76 for measuring the density of the developed image on the photoconductor, or an electrometer 50*a* or 50*b* for detecting the voltage of the image on the photoconductor, detects mottle or banding on the developed image. The densitometer 76 or electrometer 50*a* or 50*b* has an aperture small enough to detect mottle or banding with wavelengths perceptible by human eyes. A logic and control unit 24 averages the image density or voltage measurements, calculates the variations of the measurements about the average and the periodicities of the measurements, and if the variations or periodicities indicate mottle or banding is present, changes the operation of one or more stations to reduce mottle or banding.

16 Claims, 3 Drawing Sheets

REDUCTION OF BANDING AND MOTTLE IN ELECTROPHOTOGRAPHIC SYSTEMS

CROSS-REFERENCE TO RELATED APPLICATIONS

This patent application claims the benefit of the priority date of Provisional patent application Ser. No. 60/302,457 filed Jul. 2, 2001.

FIELD OF INVENTION

This invention relates to electrophotographic recording apparatus such as that used in document copiers and printers, and more specifically to output quality control in an electrophotographic recording apparatus.

Definitions

The following terms well-known in the art are defined here:

$I_{exp}$—Writer current used during exposure.

$V_{exp}$—Writer voltage used during exposure.

$E_0$—Light produced by the print head.

E—Actual exposure of photoconductor.

$V_0$—Primary voltage (relative to ground) on the photoconductor just after the charger. This is sometimes referred to as the "initial" voltage.

$V_B$—Development station electrode bias.

$V_{grid}$—A grid control signal that controls the transfer of initial charge to the photoconductor.

Discussion of Prior Art

Process control for electrophotographic systems is based on measurement and control of image density. However, images that have acceptable density on average can have undesirable levels of banding or mottle. "Banding" refers to the appearance on an output image of darker or lighter bands, running in a direction perpendicular to the direction of motion of the image through the development process, in areas where no change in input image brightness exists. Banding is generally due to speed variations in image movement, often caused by gear noise, stepper motor frequencies, or scanner frequency variations. "Mottle" refers to the appearance on an output image of darker or lighter patches in areas where no change in input image brightness exists. In general mottle does not exhibit a regular pattern.

U.S. Pat. No. 6,121,986 (Regelsberger et al.), incorporated herein by reference, teaches the use of the densitometer to monitor development of test patches to provide real-time control of the electrophotographic process and to provide "constant" image quality output, and the use of the electrometer to measure a calibration patche in an interframe area on the photoconductor. U.S. Pat. No. 5,937,229 (Walgrove et al.), also incorporated herein by reference, reveals use of the densitometer and the electrometer in the same way. Both patents spell out the mechanism and process in detail. Neither of the above patents addresses the problem of banding. Both patents address mottle by increasing toner density based on overall test patch density measurement.

The parameters defined above are important for understanding the operation and control of typical electrophotographic systems. Light intensity $E_0$ produced by the print head illuminates the photoconductor and causes a particular level of exposure E of the photoconductor. In general contrast and toner density control are achieved by varying levels of $V_0$, $E_0$, and $V_B$ as is well-known and described in the published literature.

For the structure and operation of a typical toning station core, see U.S. Pat. No. 4,602,863 (Fritz, et al.), incorporated herein by reference.

SUMMARY

The invention detects mottle or banding in a developed electrophotographic image. It operates within an electrophotographic reproduction apparatus with a photoconductor used for receiving and developing a latent image. The photoconductor traverses a path that passes a charging station, an exposure station, a toning station, and a transfer station. The charging station charges the photoconductor to a desired level of electric charge. The exposure station exposes the photoconductor to an input document or document image to selectively discharge the photoconductor and form a latent image of the input document or document image. The toning station applies toner to the photoconductor to develop the latent image. The transfer station transfers the developed latent image to a receiver sheet. The invention detects mottle or banding using either a densitometer for measuring the density of the developed image on the photoconductor, or an electrometer for detecting the voltage of the image on the photoconductor. The densitometer or electrometer has an aperture small enough to detect mottle or banding with wavelengths perceptible by human eyes. The invention's processor averages the image density or voltage measurements, calculates the variations of the measurements about the average and the periodicities of the measurements, and if the variations or periodicities indicate mottle or banding is present, changes the operation of one or more stations to reduce mottle or banding.

DETAILED DESCRIPTION OF INVENTION

Figure 1:
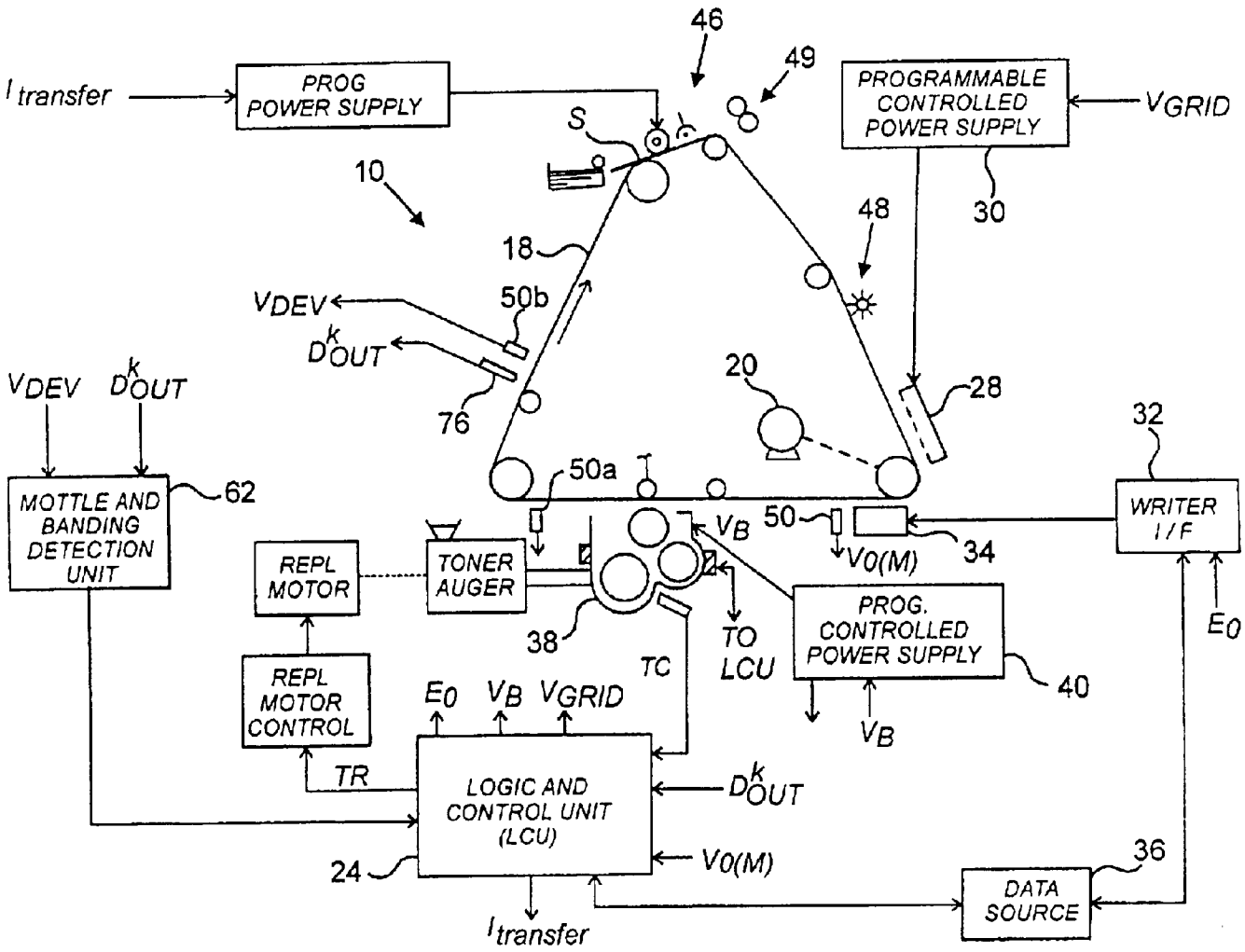
FIG. 1 shows the invention as installed in a typical electrophotographic printing system.

The machine 10 diagrammed in FIG. 1, an electrophotographic printer, is typical of devices containing the invention. In machine 10, a moving recording member such as photoconductive belt 18 is driven by a motor 20 past a series of work stations of the printer. A logic and control unit (LCU) 24 has a digital computer that operates a stored program for sequentially actuating the electrophotographic stations. The invention's mottle and banding detection unit 62 provides signal inputs to LCU 24 to direct changes to operating parameters for machine 10. Detection unit 62 is shown here as a separate component, to highlight the invention's structure and operation. Detection unit 62 may exist as a separate component or as an integrated subsystem of LCU 24.

In typical devices such as machine 10, charging station 28 sensitizes belt 18 by applying a uniform electrostatic charge of predetermined primary voltage $V_0$ to the surface of the belt 18. The output of the charger 28 is regulated by a programmable controller 30, which is in turn controlled by LCU 24 to adjust primary voltage $V_0$ in accordance with a grid control signal, $V_{grid}$ that controls movement of charges from charging wires to the surface of the recording member, as is well-known.

Exposure station 34, projects light from a write head to dissipate the electrostatic charge on the photoconductive belt 18 to form a latent image of the document being copied or printed. The write head preferably has an array of light-emitting diodes (LEDs) or some other light source such as lasers for exposing the photoconductive belt picture element (pixel) by picture element. LCU 24 determines the exposure intensity $E_0$ and directs its regulation using a data source programmable controller 36. Alternatively, the exposure may be by optical projection of an image of a document onto the photoconductor. Another alternative is creating electrostatic latent images using needle-like electrodes or other known means for forming such latent images.

Where an LED or other electro-optical exposure source is used, a data source 36 such as a computer, a document scanner, a memory, or a data network provides image data for recording. Signals from data source 36 and/or LCU 24 may also provide control signals to a writer network and other components. Signals from the data source 36 and/or LCU 24 may also provide control signals to a writer interface 32 for identifying and selecting exposure correction parameters for use in controlling image density. In order to form test patches of specific densities, the LCU 24 may be provided with ROM memory to store patch creation data for each desired level of toner density. LCU 24 transfers the patch creation data as needed into data source 36. Travel of belt 18 brings the areas bearing the latent charge images, including patches, into a development station 38. Development station 38 has magnetic brushes in juxtaposition to the travel path of belt 18. Magnetic brush development stations are well-known. See U.S. Pat. No. 4,602,863 (Fritz, et al.), already incorporated herein by reference.

In relation to the passage of the image areas, LCU 24 selectively activates the development station 38 containing latent images. This activation selectively brings the magnetic brush of development station 38 into engagement with, or a small spacing from, belt 18. The electric charge of the latent image pattern attracts the charged toner particles of the engaged magnetic brush imagewise to develop the pattern on belt 18.

As is well understood in the art, conductive portions of the development station 38, such as conductive applicator cylinders, act as electrodes. The electrodes are connected to a variable supply of D.C. or A.C.+D.C. potential $V_B$. $V_B$ is supplied by programmable controller 40 that is regulated by LCU 24. Details regarding the development station 38 are not essential to the invention.

As is also well-known, a transfer station 46 moves a receiver sheet S into engagement with the photoconductor on belt 18, in register with the image, for transferring the image from belt 18 to receiver S. Alternatively, the image may be transferred to an intermediate member, and then from the intermediate member to receiver S. A cleaning station 48 downstream from transfer station 46 removes residual toner from belt 18 to allow reuse of the surface for forming additional images. A belt 18, a drum photoconductor, or other structure for maintaining a charged image in toner may be used for supporting an image for toner transfer. After transfer of the unfixed toner images to receiver sheet S, sheet S is transported to a fuser station 49 where the image is fixed.

LCU 24 provides overall control of the apparatus and its various subsystems as is well-known. Programming commercially available microprocessors is a conventional skill well understood in the art. LCU 24 maintains and stores parametric values necessary for the operation of both the invention and the overall electrophotograhic apparatus 10.

In a first embodiment, the invention measures the density of a process control patch with a small aperture densitometer 76 to determine both the average density and fluctuations in density that indicate mottle or banding. A densitometer 76 with an aperture of approximately 1 $mm^2$ is preferred, since the peak sensitivity of the human eye to noise is at spatial wavelengths of approximately ⅛ inch. In an alternate embodiment, an electrometer 50*a* or 50*b* with a small aperture and rapid response time is used to measure non-uniformities in the image voltage. The densitometer 76 or electrometer 50*a* or 50*b* is situated as shown between development station 38 and transfer station 48 along the path of movement of the developed latent image on photoconductive belt 18. The two electrometer locations showing at 50*a* and 50*b* are presented to show the range of acceptable locations along the image path intermediate between the toning station 38 and transfer station 46. The electrometer spacing from the photoconductor is typically 0.100"+/−0.035".

Photodiodes typically used in densitometer 76 for this application include PIN silicon photodiodes types OP913SL and OP913WSL having acceptance angles of 10 degrees and 30 degrees respectively from the optical axis. These units can detect very low light levels, a characteristic making them qualified for use in the invention. The use of a pinhole opening to mask the photodiode reduces the photodiode's working acceptance angle, thereby allowing the detection of smaller nonuniformities in toner density as required.

In electrometer 50*a* or 50*b* for this application, electrostatic non-contact voltmeters used include the Trek Model 370 or equivalent, which has a response speed of approximately 50 microseconds and an aperture approximately 2 mm in diameter. Alternately, a CCD array with linearity of frequency response comparable to that of acceptable photodiode detectors is usable for measurement of optical density fluctuations. Density determination using a CCD array is done with image analysis software for spot and band detection and measurement, as is well-known.

The aperture and response time of the photodiode, the electrometer, and the CCD array are appropriate for detecting nonuniformities with spatial wavelengths on the order of ⅛ inch or less.

Using the detection inputs, LCU 24 calculates average density, variation about the average, and periodic variation. Process control adjusts density so that the average density is in an acceptable range. If either mottle or banding or both are present, LCU 24 directs the increase of toner density by making appropriate increases in $E_0$, $V_B$, and $V_0$. If toner density level is acceptable but banding is present, LCU 24 increases the magnetic core speed of development station 38.

A detection unit 62 detects mottle and banding, and distinguishes between them. In a basic embodiment, the invention uses a single densitometer as detector 76, and takes multiple density readings from each test patch as required. The invention operates in this embodiment as follows.

Figure 2A:
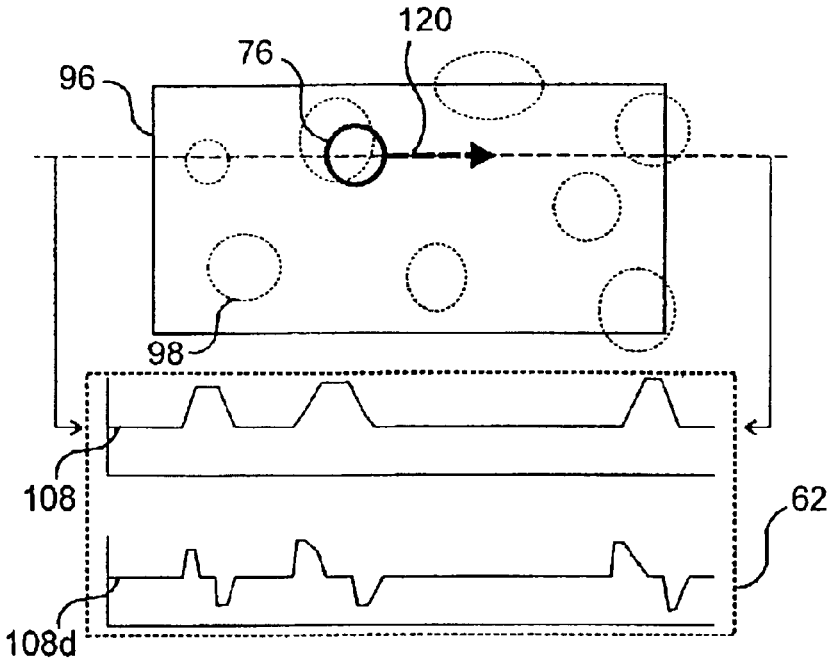
FIG. 2*a* shows the detection of mottle on a test patch of toner, using a single detector photodiode.
Figure 2B:
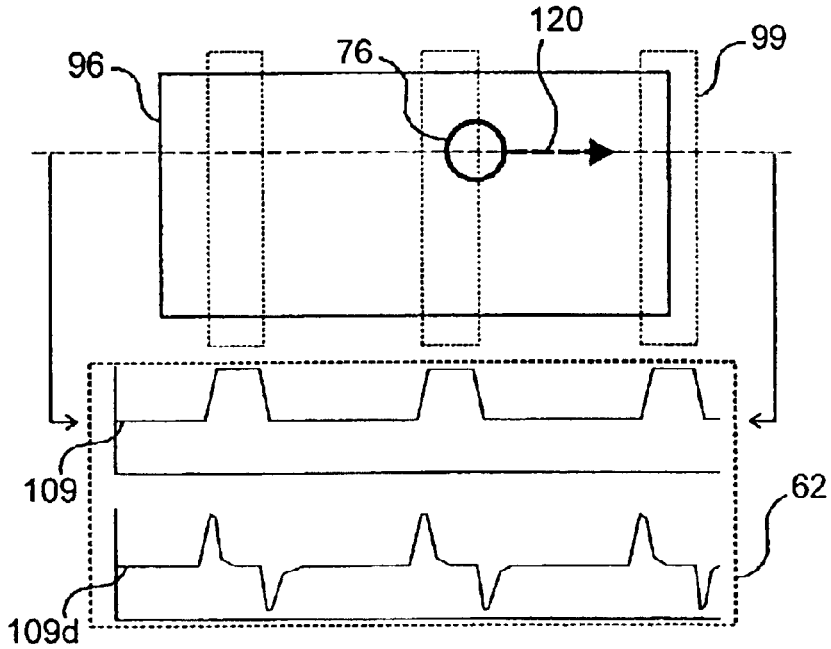
FIG. 2*b* shows the detection of banding on a test patch of toner, using a single detector photodiode.

See FIGS. 2*a* and 2*b*, showing a test patch 96, with mottle 98 and banding 99 respectively. A detection unit 62 has a single detector photodiode 76. For convenience of illustration, detector 76 is shown as moving in direction 120 with respect to test patch 96. The detector is actually in a fixed position in machine 10, while belt 18 and the test patch on it are moving in the direction opposite to that shown. Mottle conditions will cause the detector 76 to change readings at irregular intervals, as shown by the density level trace 108 and its first derivative trace 108*d*. Banding conditions will cause the detector 76 to change readings on a regularly periodic basis, as shown by the density level trace 109 and its first derivative trace 109*d*. A test patch 96 on photoconductive belt 18 moves past detector 76 at a distance enabling detector 76 to detect toner nonuniformities of approximately 2 mm in size in test patch 96. Detector 76 detects changes in density of test patch 96 along the direction of travel of the test patch. Detection unit 62 takes multiple densitometer readings for each test patch 96. Detection unit 62 counts each significant change in density on a test patch 96, producing a positive count pulse for each increase and a negative count pulse for each decrease. Detection unit 62 records the time intervals between successive pairs of positive count pulses. Detection unit 62 sums the positive count pulses in a first sum, and the negative count pulses in a second sum, from all detectors. If detection unit 62 detects counts above a specific threshold for both the first sum and the second sum, it signals a mottle or banding condition. Detection unit 62 compares the time intervals between successive pairs of positive count pulses. If time intervals between successive pairs of positive count pulses are approximately equal, detection unit 62 signals a banding condition. If detection unit 62 detects a mottle condition or a banding condition, it directs an increase in toner density via LCU 24. If detection unit 62 detects a banding condition, it directs an increase in magnetic core speed via LCU 24.

In summary, detection unit 62 compares the intervals between succeeding count pulses from a test patch. If the time interval between pulses A and B matches that between B and C, and that between C and D, the regularity of appearance of the pulses implies a banding condition. Pulses appearing irregularly imply a mottle condition. The condition detected drives adjustment of toner density and/or development station core speed as required.

Alternate Embodiments of the Invention

Figure 3A:
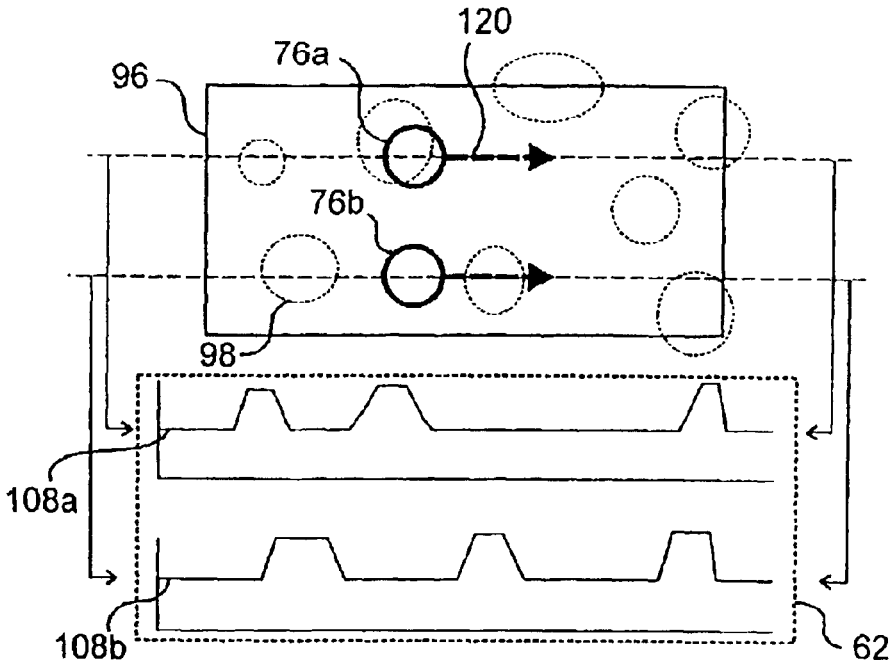
FIG. 3*a* shows the detection of mottle on a test patch of toner, using multiple detector photodiodes.
Figure 3B:
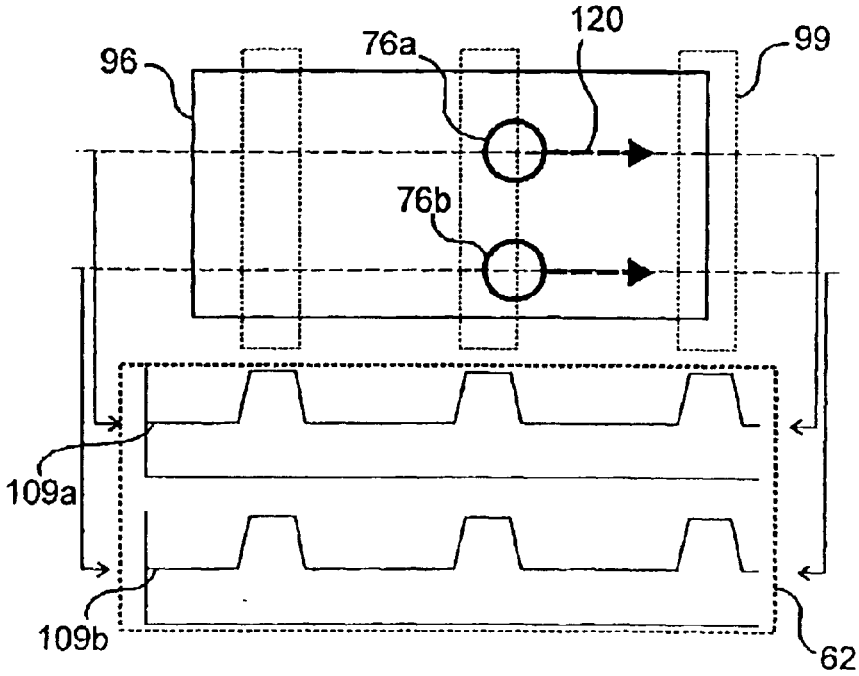
FIG. 3*b* shows the detection of banding on a test patch of toner, using multiple detector photodiodes.

In another embodiment, the invention replaces the single detector by multiple detectors disposed across the test patch in a row perpendicular to the direction of travel. See FIGS. 3*a* and 3*b*, showing a test patch 96, with mottle 98 and banding 99 in the respective figures. A detection unit 62 has two detectors 76*a* and 76*b*. Additional detectors may be disposed along the same line as detectors 76*a* and 76*b*, as desired. Again, for convenience of illustration, detector 76 is shown as moving in direction 120 with respect to test patch 96. The detector is actually in a fixed position, while belt 18 and the test patch on it are moving in the direction opposite to that shown. Mottle conditions will cause detectors 76*a* and 76*b* to change readings at irregular intervals, as shown by the density level traces 108*a* and 108*b*. Banding conditions 99 as shown in FIG. 3*b* will cause most or all detectors to change readings synchronously, as shown by the density level traces 109*a* and 109*b*. The small-aperture detectors 76*a* and 76*b* detect changes in density of the test patch along the direction of travel of the test patch. Using the detector inputs, detection unit 62 counts each significant change in density on the test patch, emitting a positive count pulse for each increase and a negative count pulse for each decrease. Detection unit 62 sums the count pulses from all detectors. If detection unit 62 detects counts above a specific threshold, it signals a mottle or banding condition. If pulses from most or all detectors arrive synchronously, detection unit 62 signals a banding condition. If detection unit 62 detects a mottle condition or a banding condition, it directs an increase in toner density. If detection unit 62 detects a banding condition, it directs an increase in magnetic core speed.

In still another embodiment, the invention replaces the densitometer or electrometer with a CCD array for detecting and reporting test patch density fluctuations. The CCD detects the amount of light transmitted through the film and density patch.

In still further embodiments, detector photodiodes may be replaced by photocells or other photodetectors with substantially the same detection performance characteristics.

Conclusion, Ramifications, and Scope of Invention

This invention allows production of images that have acceptable, low toner stack heights, minimal mottle, and minimal banding. The invention adjusts toner density to address mottle and banding conditions accurately. This accuracy reduces toner consumption by obviating the manual setting of toner density at a too-high level to avoid mottle or banding. From the above descriptions, figures and narratives, the invention's advantages in these respects should be clear.

Although the description, operation and illustrative material above contain many specificities, these specificities should not be construed as limiting the scope of the invention but as merely providing illustrations and examples of some of the preferred embodiments of this invention.

Thus the scope of the invention should be determined by the appended claims and their legal equivalents, rather than by the examples given above.

What is claimed is:

1. An electrophotographic reproduction apparatus comprising:

a photoconductor traveling along a path for receiving and developing a latent image, the photoconductor traversing a path that passes a plurality of processing stations including a charging station for charging the photoconductor to a desired charge level, an exposure station for exposing the photoconductor to an input document or document image to selectively discharge the photoconductor and form a latent image of the input document or document image, a toning station for applying toner to the photoconductor to develop the latent image, a transfer station for transferring the developed latent image to a receiver sheet, and means for detecting mottle or banding in the developed latent image, and means for adjusting one or more of the stations to reduce mottle or reduce banding.

2. The electrophotographic apparatus of claim 1 wherein the means for detecting mottle or banding comprises one or more densitometers for measuring the density of the developed image on the photoconductor.

3. The electrophotographic reproduction apparatus of claim 2 wherein the densitometer has an aperture small enough to detect mottle or banding with spatial wavelengths perceptible by human eyes.

4. The electrophotographic reproduction apparatus of claim 1 wherein the means for detecting mottle or banding comprises one or more electrometers for detecting the voltage of the image on the photoconductor.

5. The electrophotographic reproduction apparatus of claim 1 wherein the means for detecting mottle or banding comprises an array of charge coupled devices.

6. The electrophotographic reproduction apparatus of claim 2 further comprising a processor for averaging the density measurements, calculating the variations of the measurements about the average and the periodicities of the measurements, and if the variations or periodicities indicate mottle or banding is present, then changing the operation of one or more stations to reduce mottle or banding.

7. The electrophotographic reproduction apparatus of claim 6 further comprising a processor for averaging the voltage measurement of the photoconductor image, calculating the variations of the measurements about the average and the periodicities of the measurements, and if the variations or periodicities indicate mottle or banding is present, then changing the operation of one or more stations to reduce mottle or banding.

8. An electrophotographic reproduction process for reducing banding or mottle comprising the steps of:

moving a photoconductor along a path for receiving and developing a latent image, charging the photoconductor to a desired charge level, exposing the photoconductor to a document to selectively discharge the photoconductor and form a latent image of the document, applying toner to the latent image to develop the latent image into a toner image, transferring the developed latent image to a receiver sheet, detecting mottle or banding, and adjusting one or more of the foregoing steps to reduce mottle or reduce banding.

9. The process of claim 8 wherein the step of detecting mottle is performed by a densitometer, an electrometer or a charge coupled device.

10. The process of claim 8 wherein the step of detecting mottle or banding comprises a measuring of the density of the developed image on the photoconductor.

11. The process of claim 10 further comprising a step of reducing an aperture of a densitometer to a size small enough to detect mottle or banding with spatial wavelengths perceptible by human eyes.

12. The process of claim 8 wherein the step of detecting mottle or banding comprises measuring the voltage of the image on the photoconductor.

13. The process of claim 10 further comprising:

averaging the density measurements, calculating the variations of the measurements about the average and the periodicities of the measurements, and if variations or periodicities indicate mottle or banding is present, then changing the operation of one or more stations to reduce mottle or banding.

14. The process of claim 8 further comprising:

averaging the voltage measurement of the photoconductor image, calculating the variations of the measurements about the average and the periodicities of the measurements, and if variations or periodicities indicate mottle or banding is present, then changing the operation of one or more stations to reduce mottle or banding.

15. The process of claim 14 wherein said changing the operation of one or more stations includes at least one of:

increasing toner density when either mottle or banding is detected; and increasing a magnetic core speed of a development station when banding is detected.

16. The process of claim 15 wherein said increasing toner density step comprises increasing at least one of $E_0$, $V_B$ and $V_0$.

* * * * *